US010542790B2

(12) United States Patent
Kazarian

(10) Patent No.: US 10,542,790 B2
(45) Date of Patent: Jan. 28, 2020

(54) SELECTIVELY TEXTURED FOOTBED

(71) Applicant: Alexander Sidney Kazarian, Boston, MA (US)

(72) Inventor: Alexander Sidney Kazarian, Boston, MA (US)

( * ) Notice: Subject to any disclaimer, the term of this patent is extended or adjusted under 35 U.S.C. 154(b) by 92 days.

(21) Appl. No.: 15/523,538

(22) PCT Filed: Nov. 17, 2015

(86) PCT No.: PCT/US2015/061131
§ 371 (c)(1),
(2) Date: May 1, 2017

(87) PCT Pub. No.: WO2016/081482
PCT Pub. Date: May 26, 2016

(65) Prior Publication Data

US 2017/0303635 A1 Oct. 26, 2017

Related U.S. Application Data

(60) Provisional application No. 62/080,458, filed on Nov. 17, 2014.

(51) Int. Cl.

| | |
|---|---|
| ***A43B 17/00*** | (2006.01) |
| ***A43B 13/18*** | (2006.01) |
| ***A43B 13/38*** | (2006.01) |
| ***A43B 7/14*** | (2006.01) |
| ***A41B 11/00*** | (2006.01) |
| ***A43B 13/12*** | (2006.01) |
| ***A43B 17/02*** | (2006.01) |

(52) U.S. Cl.
CPC ..... *A43B 13/186* (2013.01); *A41B 11/007* (2013.01); *A43B 7/146* (2013.01); *A43B 13/12* (2013.01); *A43B 13/188* (2013.01); *A43B 13/38* (2013.01); *A43B 17/00* (2013.01); *A43B 17/02* (2013.01)

(58) Field of Classification Search
CPC ..... A43B 7/1455; A43B 7/146; A43B 13/38; A43B 17/00
USPC ..... 36/43, 44, 141
See application file for complete search history.

(56) References Cited

U.S. PATENT DOCUMENTS 1,167,885 A * 1/1916 Carll ..... A43B 7/146 36/32 R
2,323,579 A 7/1943 Vigorith ..... 36/71
(Continued)

OTHER PUBLICATIONS

International Bureau of WIPO, International Preliminary Report on Patentability—International Application No. PCT/US2015/061131, dated May 23, 2017, 7 pages.
(Continued)

*Primary Examiner* — Marie D Bays
(74) *Attorney, Agent, or Firm* — Sunstein Kann Murphy & Timbers LLP

(57) ABSTRACT

Selectively textured footbeds for athletic footwear are described. A footbed includes a rearfoot portion and a plurality of discrete raised areas extending from the rearfoot portion. The discrete raised areas are constructed and arranged to engage a rearfoot region of a plantar surface of a foot. The footbeds provide a sensory input to the plantar surface to allow a user to determine whether and/or how to adjust his or her gait.

13 Claims, 8 Drawing Sheets

(56) References Cited

U.S. PATENT DOCUMENTS 3,722,113 A * 3/1973 Birkenstock ..... A43B 7/141 36/11.5
3,757,774 A * 9/1973 Hatuno ..... A43B 3/128 36/141
4,345,387 A * 8/1982 Daswick ..... A43B 7/146 36/29
4,694,831 A 9/1987 Seltzer ..... 128/582
4,897,937 A 2/1990 Misevich et al. ..... 36/43
5,664,342 A * 9/1997 Buchsenschuss ..... A43B 7/144 36/141
6,715,221 B1 * 4/2004 Sasaki ..... A43B 1/0045 36/141
8,051,582 B2 * 11/2011 Nurse ..... A41B 11/10 36/144
8,769,846 B1 7/2014 Williams ..... 36/141
2006/0059725 A1 * 3/2006 Lien ..... A43B 7/146 36/141
2007/0271820 A1 * 11/2007 Nurse ..... A41B 11/10 36/43
2008/0022561 A1 * 1/2008 Klavano ..... A43B 7/146 36/141
2008/0301975 A1 * 12/2008 Fusco ..... A43B 7/14 36/43
2009/0038179 A1 2/2009 Chen ..... 36/41
2012/0167414 A1 * 7/2012 Shrairman ..... A43B 7/1415 36/88
2013/0104419 A1 * 5/2013 Horesh ..... A43B 7/1425 36/43
2014/0033565 A1 * 2/2014 Aruin ..... A43B 13/38 36/43
2015/0143714 A1 * 5/2015 Tzeng ..... A43B 1/0081 36/43
2016/0309838 A1 * 10/2016 Ha ..... A43B 7/146
2017/0303635 A1 * 10/2017 Kazarian ..... A43B 13/186
2017/0340062 A1 * 11/2017 Qin ..... A43B 17/08

OTHER PUBLICATIONS

International Searching Authority, International Search Report—International Application No. PCT/US2015/061131, dated Mar. 2, 2016, together with the Written Opinion of the International Searching Authority, 14 pages.

* cited by examiner

SELECTIVELY TEXTURED FOOTBED

CROSS-REFERENCE TO RELATED APPLICATIONS

This application claims the benefit under 35 U.S.C. § 119(e) of U.S. provisional application Ser. No. 62/080,458, filed Nov. 17, 2014, the disclosure of which is herein incorporated by reference in its entirety.

FIELD

Disclosed embodiments are generally related to footwear and more particularly to textured footbeds for engaging the plantar surface of a foot.

BACKGROUND

Traditional running and athletic footwear are composed of two main components: an upper member and a sole structure. The upper member serves to secure a foot and position it relative to the sole structure. The sole structure is positioned between the foot and the contact surface, e.g. the ground, and is generally provided to protect the foot from the ground surface, add cushioning and comfort for the foot, and provide traction between the foot and the ground.

SUMMARY

In one aspect, a footbed includes a rearfoot portion and a plurality of discrete raised areas extending from the rearfoot portion. The plurality of discrete raised areas are constructed and arranged to engage a rearfoot region of a plantar surface of a foot.

In another aspect, a method for allowing a user to adjust his or her gait when running or walking includes engaging a rearfoot region of a plantar surface of a user's foot with a plurality of discrete raised areas that extend from a rearfoot portion of a footbed. The method further includes providing a sensory input to the rearfoot region by engagement of the plurality of discrete raised areas. The sensory input provides an indication to the user to adjust his or her gait.

It should be appreciated that the foregoing concepts, and additional concepts discussed below, may be arranged in any suitable combination, as the present disclosure is not limited in this respect. Further, other advantages and novel features of the present disclosure will become apparent from the following detailed description of various non-limiting embodiments when considered in conjunction with the accompanying figures.

In cases where the present specification and a document incorporated by reference include conflicting and/or inconsistent disclosure, the present specification shall control. If two or more documents incorporated by reference include conflicting and/or inconsistent disclosure with respect to each other, then the document having the later effective date shall control.

BRIEF DESCRIPTION OF DRAWINGS

The accompanying drawings are not intended to be drawn to scale. In the drawings, each identical or nearly identical component that is illustrated in various figures may be represented by a like numeral. For purposes of clarity, not every component may be labeled in every drawing. In the drawings.

DETAILED DESCRIPTION

Figure 1:
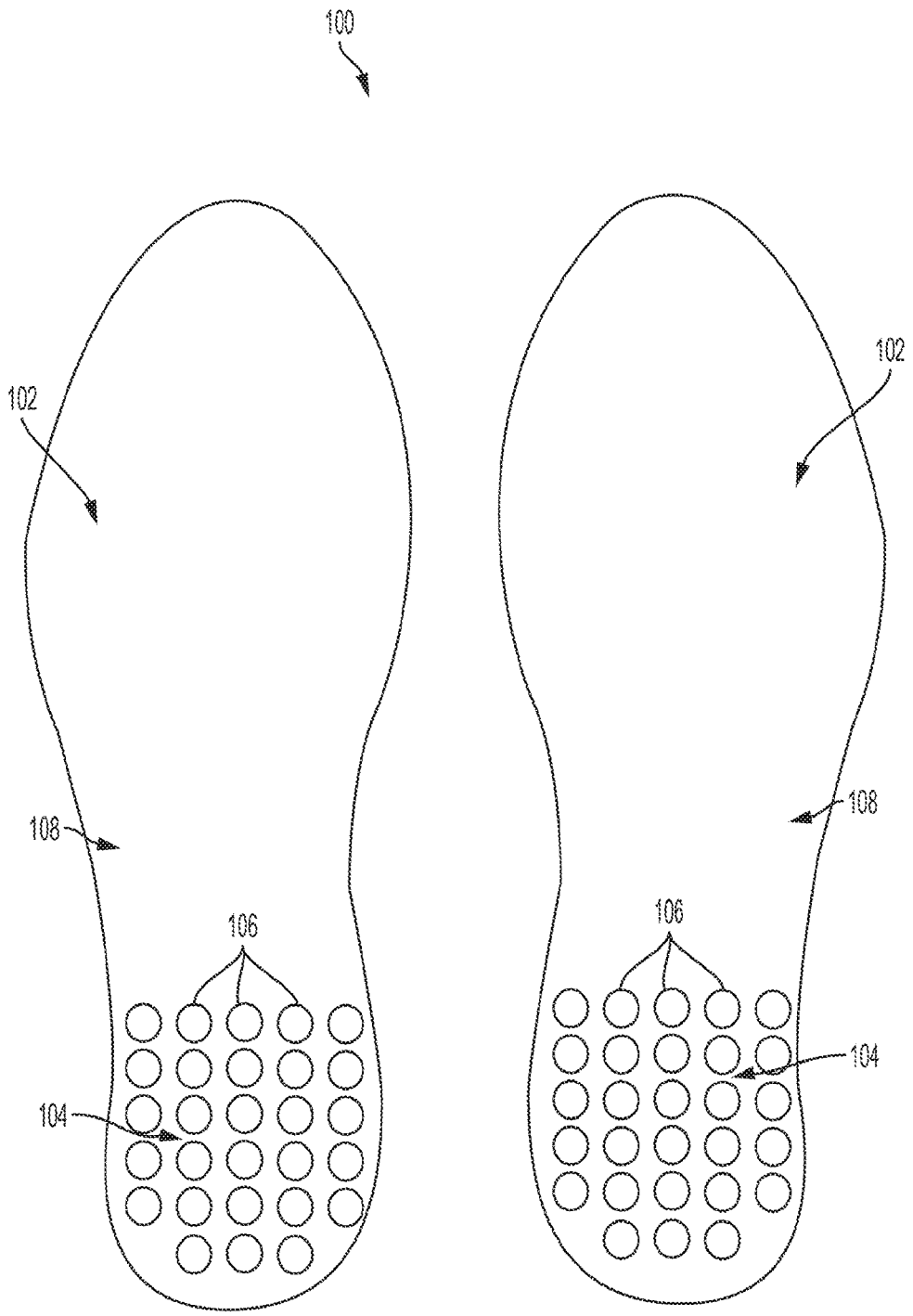
FIG. 1 is a top plan view of a schematic representation of one embodiment of a pair of footbeds each having a textured surface in a rearfoot portion.

Running styles can vary greatly from person to person, and footwear can have a large effect on an individual's running style. In general, it is found that habitual barefoot runners, who do not use footwear, tend to adapt a running style characterized by a forefoot or midfoot strike. As used herein, a forefoot strike is defined as the ball of the foot or forefoot region being the first to come in contact with the ground; a midfoot strike is defined as the foot striking the ground relatively flat wherein the forefoot and heal contact the ground relatively simultaneously. Generally, it is found that people who habitually run shod tend to adapt a running style characterized by a rearfoot strike (heel strike) in which the heel of the foot is the first part of the foot to contact the ground. It has been found that heel striking, even while shod with a traditional running shoe which provides cushioning, produces higher impact forces compared to forefoot striking while barefoot or shod. Along with lower ground impact forces, the gait patterns associated with barefoot running also may be beneficial for increasing performance and reducing the risk of running related injuries.

In view of the above, the inventor has recognized and appreciated numerous advantages associated with a selectively textured footbed for athletic footwear that encourages a user to adapt to a running style similar to that of a barefoot runner. According to some aspects, a textured footbed provides sensory input to the plantar surface of a user's foot in order to allow a user to modify or adjust his or her gait or lower extremity biomechanics during motions including walking, running, or athletic movements including lateral movements, rapid start or stop motions, etc.

The plantar surface of the foot has a high concentration of neural receptors, allowing the body to detect how the foot contacts the ground and the ground surface with which they are in contact. These neural receptors are able to detect several forms of stimuli which include small discrete displacements (e.g. indentation, bumps, ridges, or other forms of texture), sheer forces, and vibrations. Traditional running shoes reduce all three of these modes of stimulation; in particular, the smooth surface of a traditional running shoe footbed prevents small discrete displacements of the skin, shear forces are reduced due to the smooth soft insole surface which allows the foot to slide, and vibrations are also reduced due to the shock absorbing effect of the sole of the shoe. In contrast, a textured footbed as described herein may provide numerous discrete structures that may undergo small deformations and stimulate the plantar surface of a user's foot. Additionally, the textured pattern of the footbed also may increase the vibration and shear forces transmitted to the plantar surface of the foot. As described in more detail below, the texture of the footbed may be constructed and arranged to allow a user to modify or adjust his or her gait or lower extremity biomechanics. For example, such modification or adjustment may encourage a user to adapt to a running style similar to that of a barefoot runner.

As used herein, a footbed refers to any device or surface that contacts at least a portion of a plantar surface of a foot. In some embodiments, portions of the footbed may directly contact the plantar surface of the foot. Alternatively, the contact between the footbed and the foot may be indirect, such as through a sock, stocking, or other similar article. Accordingly, a textured footbed according to the present disclosure may include a textured insole (e.g., a removable insole), a textured sock or sock liner, a textured stocking, a textured upper surface of shoe sole, or any other suitable device or surface that is placed in contact with the plantar surface of the foot.

In one embodiment, a footbed is constructed and arranged such that the majority or entirety of the portion of the footbed that contacts the heel portion of the foot (i.e., the rearfoot) includes a plurality of discrete raised areas extending from the footbed that form a textured surface. The discrete raised areas may be large enough and/or hard enough such that they may be felt or sensed by a user when sufficient force is applied, e.g. body weight. In certain embodiments, the textured surface also may include a portion or the entirety of the portion of the footbed in contact with the midfoot region of the foot, e.g., the arch region of the foot between the heel and the ball of foot. In such embodiments, a second plurality of discrete raised areas may form the textured surface in the midfoot portion of the footbed. The remainder of the footbed structure including the forefoot portion and, in some embodiments, a portion or the entire midfoot portion may have a smooth or substantially smooth feel and may not include any discrete raised areas. Alternatively, a footbed may have cutouts corresponding to those portions that do not have any discrete raised areas. For example, a footbed may only include portions corresponding to areas where the desired texture is applied (e.g., the rearfoot). Accordingly, it should be understood that the current disclosure is not limited to any particular shape for a footbed.

Depending on the particular embodiment, the discrete raised areas may have any suitable size (length, width, height) and/or shape including, but not limited to, a spherical cap (e.g., a hemisphere), a cone, a parallelepiped (e.g., a cube), a cylinder, and a pyramid. The discrete raised areas may be arranged according to any suitable pattern, distribution, and spacing. For example, the discrete raised areas may be distributed uniformly or non-uniformly within an area of a footbed. Further, the discrete raised areas may extend from the footbed surface to any suitable height such that the texture can still be felt by a user to produce a desired stimulation to the foot. For example, in one embodiment, the discrete raised areas are formed as round bumps having a diameter of about 1.5 mm and extending about 1 mm from the surface of the footbed; adjacent bumps are spaced about 6 mm apart. However, as noted above, other sizes, shapes, and/or spacings between adjacent discrete raised areas may also be suitable. Moreover, the discrete raised areas may vary in size, shape, spacing, distribution, pattern, and/or height within a single footbed, as the disclosure is not so limited.

In some embodiments, the discrete raised elements may extend upwardly from a footbed towards the plantar surface of a foot. For example, a plurality of discrete raised elements may form a textured surface on the outer, upwardly facing surface of an insole that contacts the plantar surface of the foot. Alternatively or additionally, the discrete raised elements may extend downwardly from the footbed away from the plantar surface. For example, a plurality of discrete raised areas may form a textured surface on the outer surface of a sock, liner, or stocking, such that the texture can be felt through the flexible sock material when force is applied to the surface.

As noted above, the footbeds described herein are designed to stimulate the plantar surface of the foot in an order to allow a user to change his or her gait and/or lower extremity biomechanics. Such changes may occur through either conscious or unconscious means, and may be characterized by (a) reduced dorsiflexion during foot strike when running or walking, (b) a transition to forefoot or midfoot strike during running, (c) reduced ground reaction force upon foot strike when running, (d) reduced over striding during running, and (e) increased stride rate during running or walking. Other changes in gait and lower extremity biomechanics may also be observed, as the disclosure is not so limited.

According to another aspect, a method is disclosed for allowing a user to adjust his or her gait and/or lower extremity biomechanics during running, walking, or other athletic activities. In some embodiments, the method includes engaging a rearfoot region and of the plantar surface of a user's foot with a plurality of discrete raised areas that extend from a rearfoot portion of a footbed. In certain embodiments, the method may further include engaging at least a portion of a midfoot region of the plantar surface with a second plurality of discrete raised areas. As noted above, the engagement with the rearfoot and/or midfoot regions may include direct or indirect contact with plantar surface. The engagement provides a sensory input to the plantar surface that gives an indication to the user that allows the user to determine whether and/or how to modify his or her gait.

In one example, the methods described herein may encourage a runner that employs a rearfoot striking running style to adapt to a forefoot or midfoot striking style. In particular, a sensory input may be provided to the rearfoot region of the plantar surface of the user's foot by engaging a plurality of discrete raised areas extending from a rearfoot portion of a footbed with the rearfoot region. This sensory input allows the user to understand his or her gait and to adjust his or her gait if desired. In one example, the user may reduce further sensory input by limiting further engagement between the rearfoot region and the raised areas. Specifically, the user may, either consciously or unconsciously, adjust his or her gait to reduce the amount of weight applied to the rearfoot region while running, and in this manner, the user may transition to a forefoot or midfoot striking running style.

Turning now to the figures, several specific embodiments of textured footbeds are described in more detail. For the sake of clarity, certain features are described with regard to a particular embodiment. However, it should be understood that the various features and embodiments depicted in the figures and described herein may be combined in any appropriate fashion as the disclosure is not so limited.

FIG. 1 depicts a schematic representation of one embodiment of a pair of plantar surface contacting footbeds 100, each having a forefoot portion 102, a midfoot portion 108, and a rearfoot portion 104. The forefoot and midfoot portions of the footbeds 100 are smooth or substantially smooth, i.e., they do not include any discrete raised areas. The rearfoot portions 104 each include a plurality of discrete raised areas 106 extending form the footbeds that form a textured surface or feel. As illustrated, the plurality of discrete raised areas 106 is disposed on substantially the entirety of the rearfoot portions 104. The discrete raised areas may extend upwardly (i.e., towards the plantar surface of a foot), or downwardly away from the foot, and in some embodiments, a single footbed 100 may include raised areas extending both upwardly and downwardly from the footbed.

Figure 2:
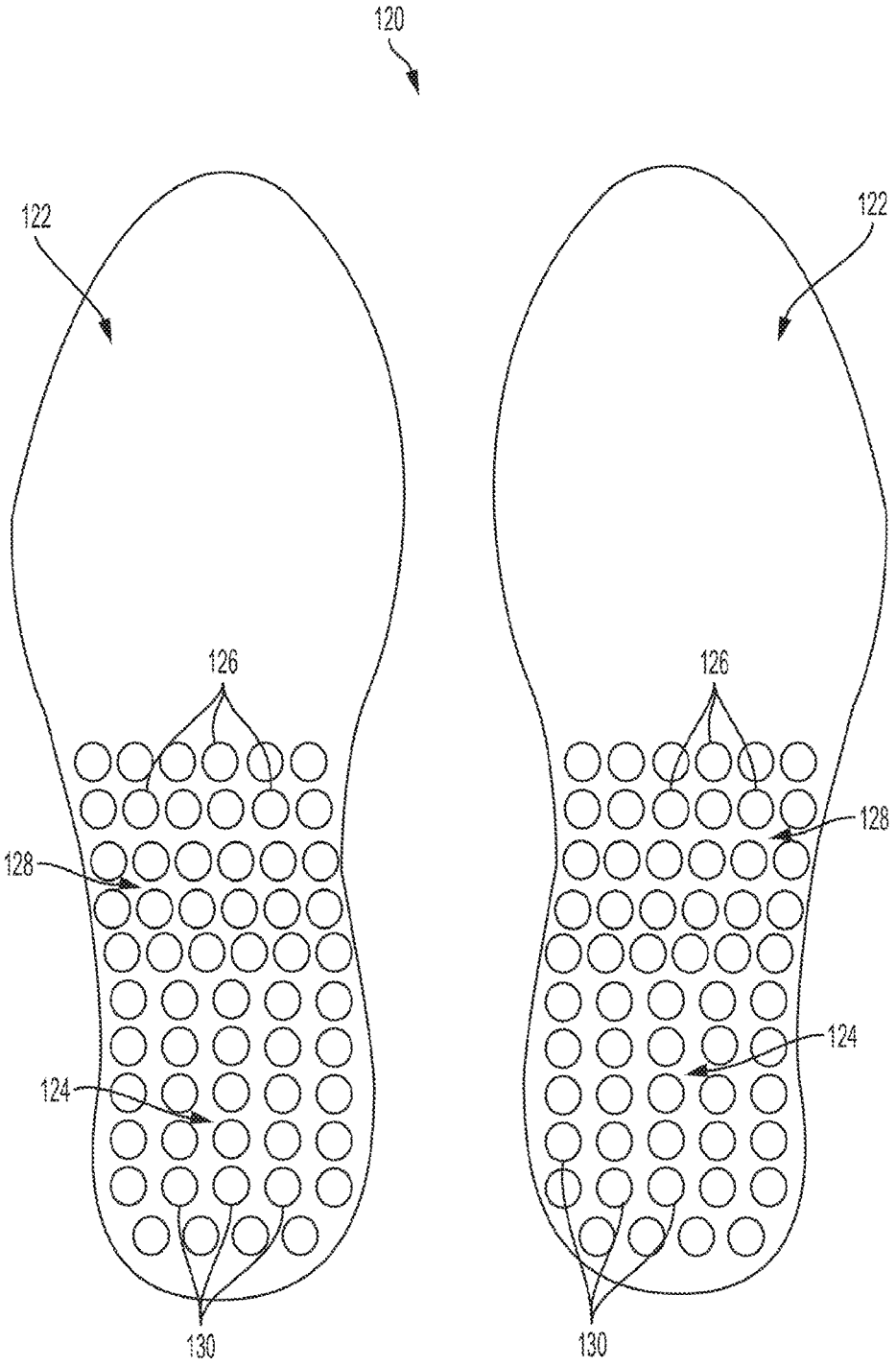
FIG. 2 is a top plan view of a schematic representation of one embodiment of a pair of footbeds each having a textured surface in a rearfoot portion and a midfoot portion.

FIG. 2 depicts a schematic representation of another embodiment of a pair of plantar surface contacting footbeds 120, each having a forefoot portion 122, a midfoot portion 128, and a rearfoot portion 124. The forefoot portions 122 of the footbeds 120 are smooth or substantially smooth, i.e., they do not include any discrete raised areas. A first plurality of discrete raised areas 130 extends from each of the rearfoot portions 124, and a second plurality of discrete raised areas 126 extends from each of the midfoot portions 128. These discrete raised areas form a textured surface or feel. In the depicted embodiment, the first and second pluralities of discrete raised areas are not distinct, and form a continuous pattern on each footbed 120. However, it should be understood that in other embodiments, the patterns of the first and second pluralities of discrete raised areas may be different and/or distinct, as the current disclosure is not so limited. Further, in this embodiment, the first and second pluralities of discrete raised areas are disposed on substantially the entireties of the rearfoot portions 124 and midfoot portions 128, respectively. The discrete raised areas may extend upwardly (i.e., towards the plantar surface of a foot), or downwardly away from the foot, and in some embodiments, a single footbed 120 may include raised areas extending both upwardly and downwardly from the footbed.

Figure 3:
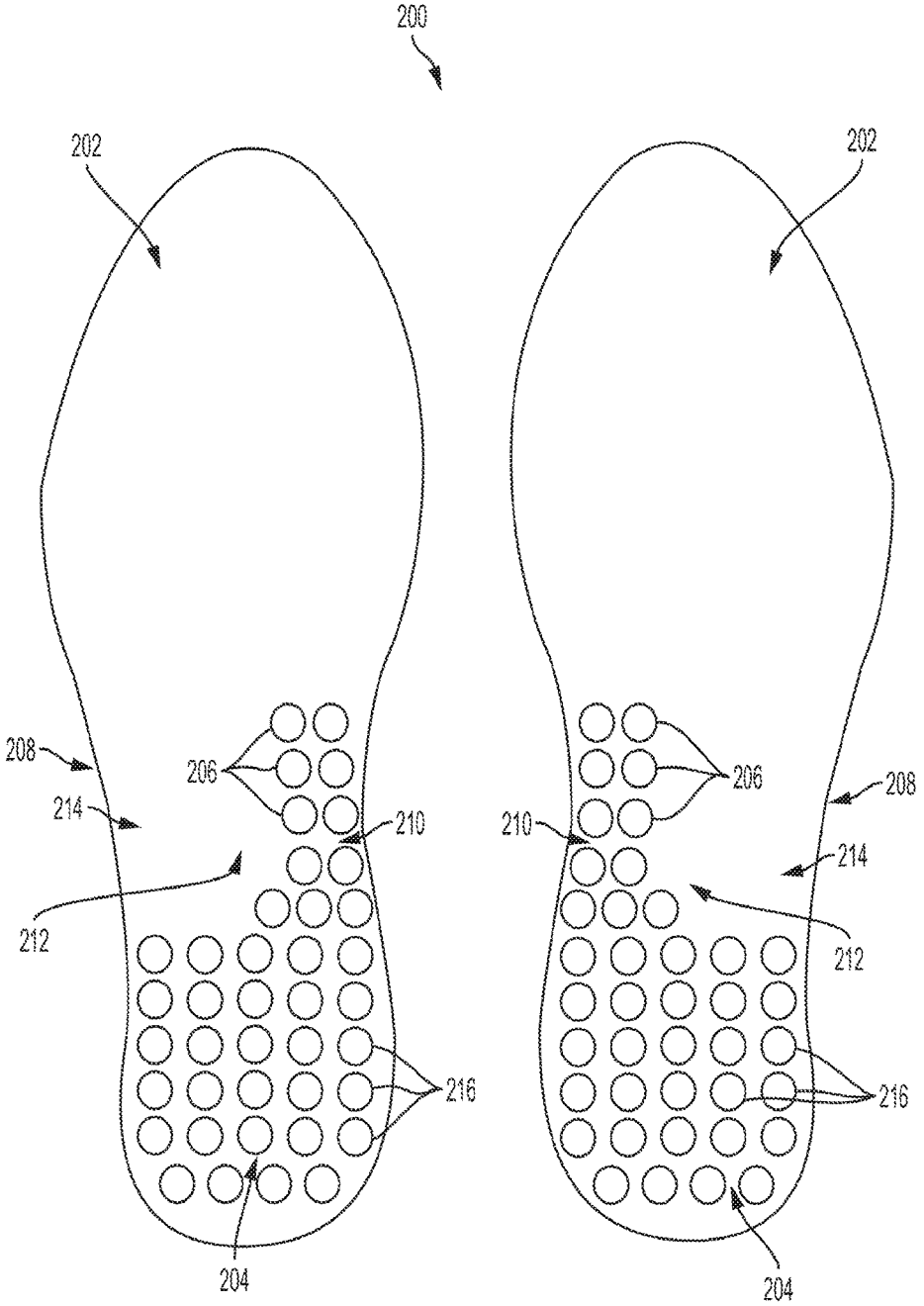
FIG. 3 is a top plan view of a schematic representation of one embodiment of a pair of footbeds each having a textured surface in a rearfoot portion and a medial area of a midfoot portion.

FIG. 3 depicts a schematic representation of one embodiment of a pair of plantar surface contacting footbeds 200, each having a forefoot portion 202, a midfoot portion 208, and a rearfoot portion 204. The midfoot portions 208 comprise a lateral area 214, a central area 212, and a medial area 210. The forefoot portions 202, the lateral areas 214, and the central areas 212 of the footbeds 200 are smooth or substantially smooth, i.e., they do not include any discrete raised areas. A first plurality of discrete raised areas 216 extends from each of the rearfoot portions 204, and a second plurality of discrete raised areas 206 extends from the medial areas 210 of each of the midfoot portions 208. These discrete raised areas form a textured surface or feel. As depicted, the first pluralities of discrete raised areas 216 are disposed on substantially the entireties of the rearfoot portions 204. The discrete raised areas may extend upwardly (i.e., towards the plantar surface of a foot), or downwardly away from the foot, and in some embodiments, a single footbed 200 may include raised areas extending both upwardly and downwardly from the footbed.

Figure 4:
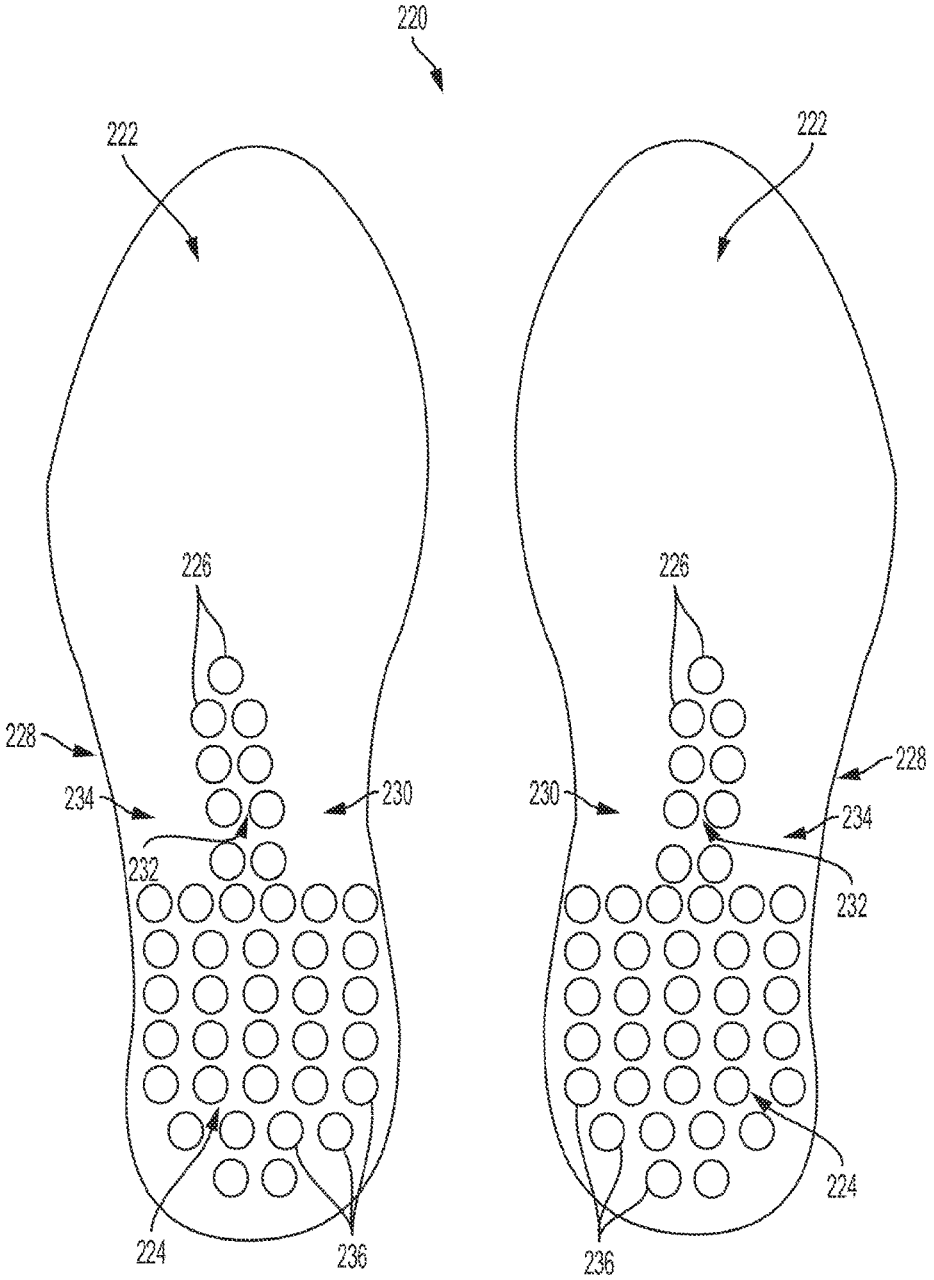
FIG. 4 is a top plan view of a schematic representation of one embodiment of a pair of footbeds each having a textured surface in a rearfoot portion and a central area of a midfoot portion.

FIG. 4 depicts a schematic representation of another embodiment of a pair of plantar surface contacting footbeds 220, each having a forefoot portion 222, a midfoot portion 228, and a rearfoot portion 224. The midfoot portions 228 comprise a lateral area 234, a central area 232, and a medial area 230. The forefoot portions 222, the lateral areas 224, and the medial areas 230 of the footbeds 200 are smooth or substantially smooth, i.e., they do not include any discrete raised areas. A first plurality of discrete raised areas 236 extends from each of the rearfoot portions 224, and a second plurality of discrete raised areas 226 extends from the central areas 232 of each of the midfoot portions 228. These discrete raised areas form a textured surface or feel. As depicted, the first pluralities of discrete raised areas 226 are disposed on substantially the entireties of the rearfoot portions 224. The discrete raised areas may extend upwardly (i.e., towards the plantar surface of a foot), or downwardly away from the foot, and in some embodiments, a single footbed 220 may include raised areas extending both upwardly and downwardly from the footbed.

Figure 5:
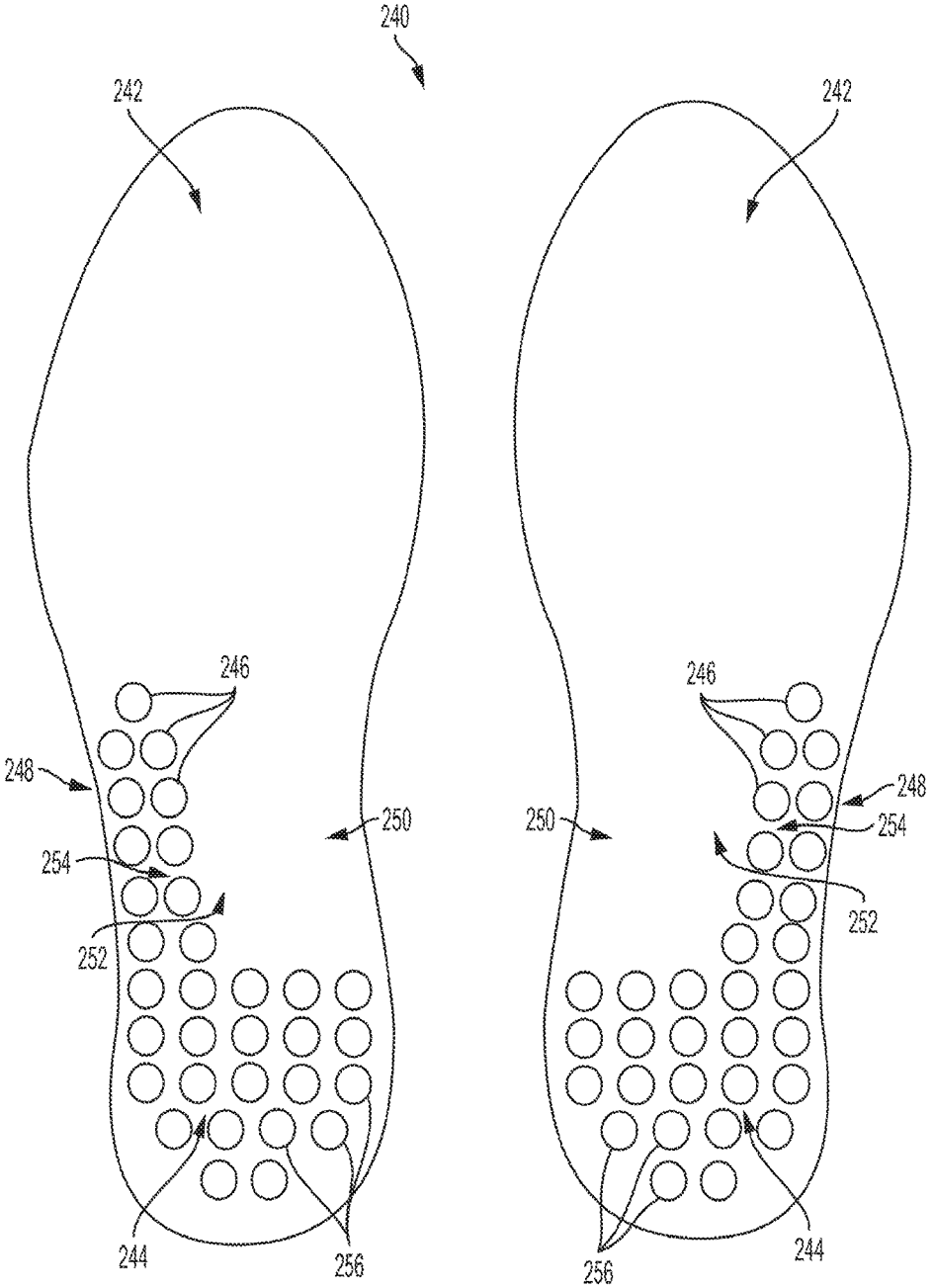
FIG. 5 is a top plan view of a schematic representation of one embodiment of a pair of footbeds each having a textured surface in a rearfoot portion and a lateral area of a midfoot portion.

FIG. 5 depicts a schematic representation of yet another embodiment of a pair of plantar surface contacting footbeds 240, each having a forefoot portion 242, a midfoot portion 248, and a rearfoot portion 244. The midfoot portions 248 comprise a lateral area 254, a central area 252, and a medial area 250. The forefoot portions 242, the central areas 252, and the medial areas 250 of the footbeds 200 are smooth or substantially smooth, i.e., they do not include any discrete raised areas. A first plurality of discrete raised areas 256 extends from each of the rearfoot portions 244, and a second plurality of discrete raised areas 246 extends from the lateral areas 254 of each of the midfoot portions 248. These discrete raised areas form a textured surface or feel. As depicted, the first pluralities of discrete raised areas 246 are disposed on substantially the entireties of the rearfoot portions 244. The discrete raised areas may extend upwardly (i.e., towards the plantar surface of a foot), or downwardly away from the foot, and in some embodiments, a single footbed 240 may include raised areas extending both upwardly and downwardly from the footbed.

Although FIGS. 1-5 depict pairs of footbeds having substantially the same pattern of raised areas, it should be understood that the individual footbeds comprising the pair of footbeds may have a different textured patterns. For example, a first footbed for use with a user's left foot may have a first pattern (e.g., the pattern corresponding to the footbeds 100 of FIG. 1), and a second footbed for use with a user's right foot may have a second pattern (e.g., the pattern corresponding to the footbeds 120 of FIG. 2). In this manner, a different selectively textured footbed may be provided specifically for each of a user's feet to allow the user to adjust his or her gait or lower extremity biomechanics as desired. Accordingly, it should be understood that the current disclosures is not limited to pairs of footbeds in which each footbed has the same textured pattern.

Figure 6:
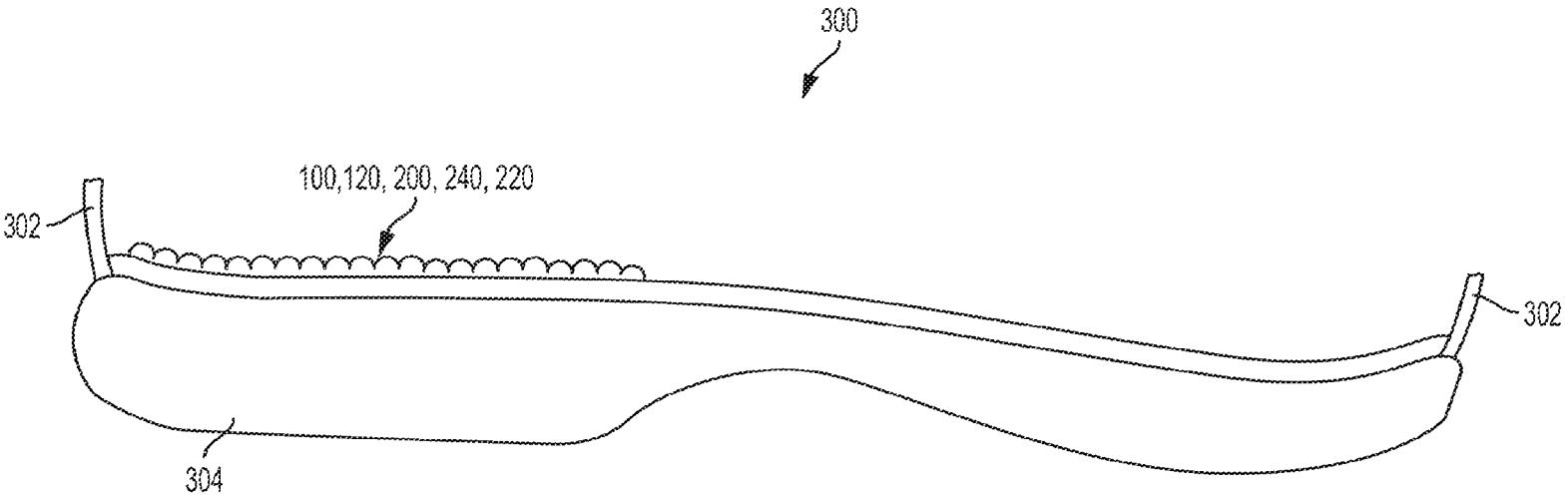
FIG. 6 is a schematic cross-sectional side view of a shoe having a footbed according to any one of the embodiments of FIGS. 1-5.

FIG. 6 illustrates a cross-sectional side view of one embodiment of a shoe 300 which includes footbeds of type 100, 120, 200, 220, or 240. The shoe 300 includes an upper member 302 and sole structure 304. The footbeds 100, 120, 200, 220, or 240 may be placed on top of the sole structure 300 as an insole and extend upwardly toward the plantar surface of a foot, or may be combined with the sole structure to form a single unit.

Figure 7:
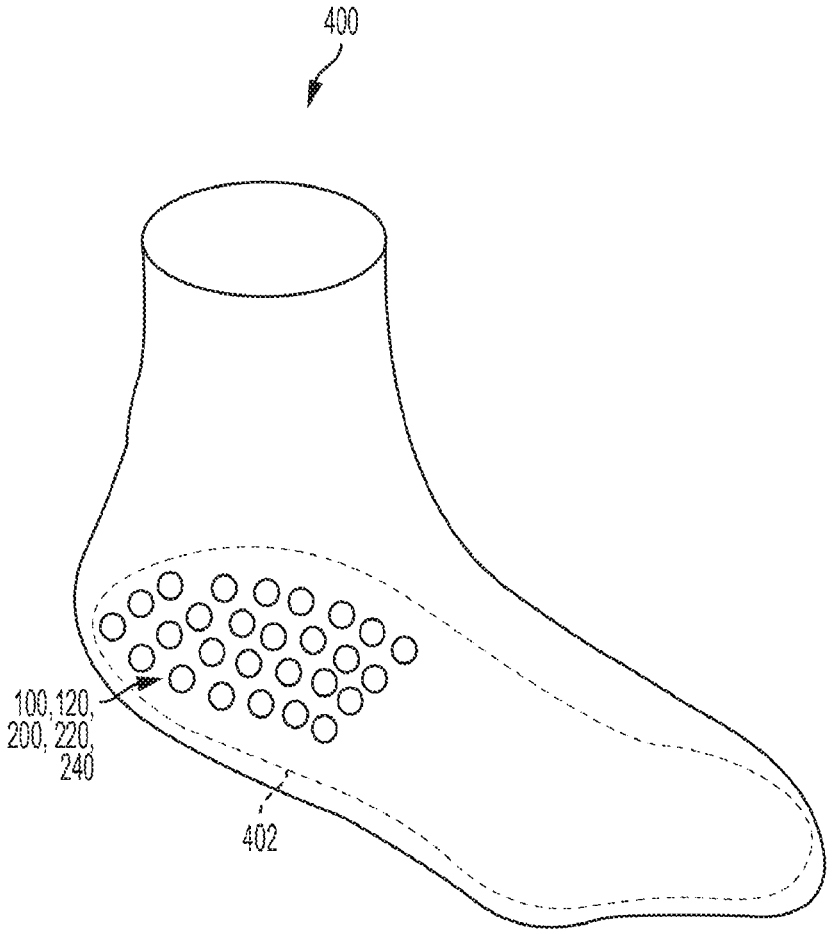
FIG. 7 is a perspective view of a schematic representation of a garment having a footbed surface according to any one of the embodiments of FIGS. 1-5.

FIG. 7 depicts one embodiment of a garment e.g. a sock, stocking, etc., 400 in which a footbed surface 402 contains any of the textured footbed patterns 100, 120, 200, 220, or 240, as described above. Depending on the particular embodiment, the footbed patterns may be disposed on an interior of the garment such that the textured pattern of the footbed directly contacts the plantar surface of a foot, or alternatively, the footbed patterns may be disposed on the exterior of the garment such that the textured pattern contacts the foot indirectly, i.e., through the garment.

Figure 8:
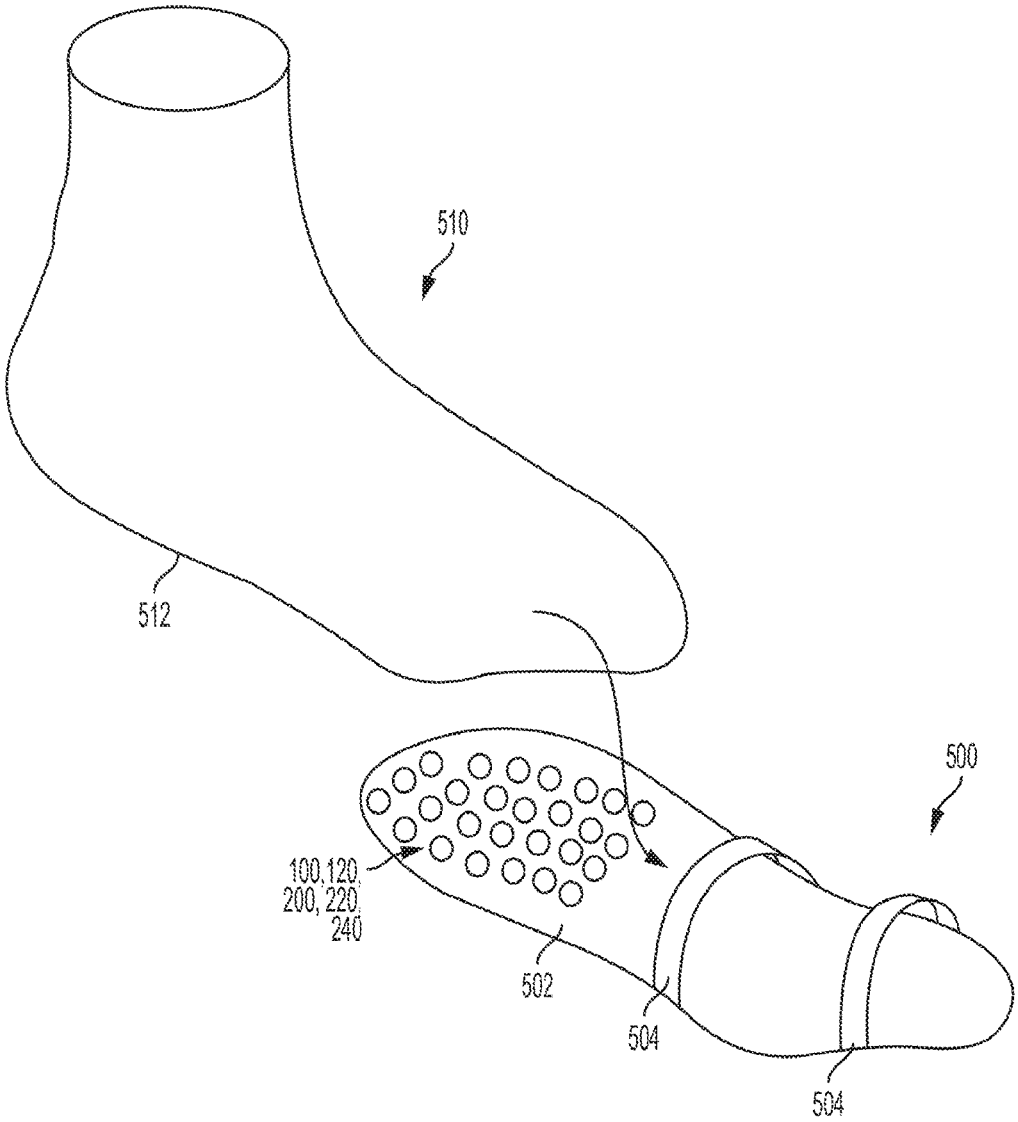
FIG. 8 is a perspective view of a schematic representation of a garment having straps and a footbed surface according to any of the embodiments of FIGS. 1-5.

FIG. 8 depicts yet another embodiment of a garment 500 in which a footbed surface 502 having any of the textured footbed patterns 100, 120, 200, 220, or 240 as described above. Attached to the garment 500 are straps 504 (which may vary in size or number) to provide a means to hold the garment to the plantar foot surface 512 of the foot 510. The foot may be either bare, or covered with a sock or other liner.

Although discrete raised areas are depicted as having a substantially uniform size and shape, and being substantially uniformly distribute, as noted above, the discrete raised areas may be arranged in any suitable pattern with any suitable spacing between adjacent discrete raised areas. Further, each discrete raised area within a plurality of discrete raised areas may have a different size and/or shape, as the current disclosure is not limited in this regard.

The footbeds described herein may be formed from any suitable material or combination of materials. For example, in one embodiment, a footbed may comprise a polymeric foam ethylene vinyl acetate (EVA), polyurethane, neoprene, etc. As noted above such foam materials may provide cushioning to reduce impact forces and/or provide additional comfort to a wearer. The foam may include a covering such as a felt material. Further, in some embodiments, a textured surface on the footbed may be formed from a material that is harder, has a higher density, or is more rigid than a foam material making up a non-textured portion of the footbed. In this manner, the textured surface may be easily felt by a plantar surface of a foot when a user applies weight to the footbed. For example, suitable materials for the textured surface include, but are not limited to, natural or synthetic rubbers, elastomers, or other plastic materials with a suitable rigidity. In further embodiments, a footbed may not include any foam material (i.e., the footbed may only comprise the textured portion). In other embodiments, the textured surface may be formed from a foam with a suitable density and/or rigidity (e.g., high-density foam) such that the texture may be felt by the user. Accordingly, it should be understood that the current disclosure is not limited to any particular materials for the textured non-textured portions.

Further, it should be understood that a footbed by be formed with any suitable manufacturing methods. For example, in one embodiment, a portion with a textured surface may be formed separately via injection molding with a thermoplastic material. The textured portion may then be compression molded with a foam sheet (e.g., EVA and/or polyurethane foam) to form a completed footbed with a desired shape. In some embodiments, a footbed may be molded in a single step (e.g., injection or compression molding) that forms both the textured and non-textured portions. Alternatively, in some embodiments, a footbed may not be formed with a molding process. For example, in one embodiment, a non-textured footbed may be provided initially, and individual raised areas or groups of raised areas may be attached to the footbed with a suitable adhesive to form a textured surface on the footbed having a desired pattern.

While the present teachings have been described in conjunction with various embodiments and examples, it is not intended that the present teachings be limited to such embodiments or examples. On the contrary, the present teachings encompass various alternatives, modifications, and equivalents, as will be appreciated by those of skill in the art. Accordingly, the foregoing description and drawings are by way of example only.

What is claimed is:

1. A footbed that encourages a runner to adapt to a running style characterized by a forefoot or midfoot strike, the footbed comprising:

a rearfoot portion;

a midfoot portion adjacent the rearfoot portion, the midfoot portion having a lateral area, a central area, and a medial area;

a first plurality of discrete raised areas extending from an entirety of the rearfoot portion, wherein the first plurality of discrete raised areas is constructed and arranged to engage a rearfoot region of a plantar surface of a foot;

a second plurality of discrete raised areas extending from a central area of the midfoot portion, wherein the second plurality of discrete raised areas is constructed and arranged to engage a central area of a midfoot region of the plantar surface of the foot, wherein each of the lateral area and the medial area do not include any discrete raised areas; and a forefoot portion adjacent the midfoot portion, wherein the forefoot portion does not include any discrete raised areas.

2. The footbed of claim 1, wherein each discrete raised area of the first plurality of discrete raised areas is shaped as at least one of a spherical cap, a cone, a parallelepiped, a cylinder, and a pyramid.

3. The footbed of claim 1, wherein a first subset of the first plurality of discrete raised areas has a first shape, and a second subset of the first plurality of discrete raised areas has a second shape different from the first shape.

4. The footbed of claim 3, wherein each of the first shape and the second shape are at least one of a spherical cap, a cone, a parallelepiped, a cylinder, and a pyramid.

5. The footbed of claim 1, wherein a first subset of the first plurality of discrete raised areas has a first size, and a second subset of the first plurality of discrete raised areas has a second size different from the first size.

6. The footbed of claim 1, wherein the first plurality of discrete raised areas are distributed uniformly across the rearfoot portion.

7. The footbed of claim 1, wherein each discrete raised area of the second plurality of discrete raised areas is shaped as at least one of a spherical cap, a cone, a parallelepiped, a cylinder, and a pyramid.

8. The footbed of claim 1, wherein a first subset of the second plurality of discrete raised areas has a first shape, and a second subset of the second plurality of discrete raised areas has a second shape different from the first shape.

9. The footbed of claim 8, wherein each of the first shape and the second shape are at least one of a spherical cap, a cone, a parallelepiped, a cylinder, and a pyramid.

10. The footbed of claim 1, wherein a first subset of the second plurality of discrete raised areas has a first size, and a second subset of the second plurality of discrete raised areas has a second size different from the first size.

11. The footbed of claim 1, wherein said footbed is at least one of an upper sole of a shoe, a removable insole, a sock, a sock liner, and a stocking.

12. A method for encouraging a user to adapt to a running style characterized by a forefoot or midfoot strike, the method comprising:

engaging a rearfoot region of a plantar surface of a foot with a first plurality of discrete raised areas, the first plurality of discrete raised areas extending uniformly across an entirety of a rearfoot portion of a footbed;

engaging only a central area of a midfoot region of the plantar surface of the foot with a second plurality of discrete raised areas, the second plurality of discrete raised areas extending from a midfoot portion of the footbed; and providing a sensory input to the rearfoot region and to the midfoot region by engagement of the first plurality of discrete raised areas with the rearfoot region, and by engagement of the second plurality of discrete raised areas with the midfoot region respectively, the sensory input providing an indication to the user to allow the user to determine whether to transition to a forefoot or midfoot strike.

13. The method of claim 12, wherein a forefoot portion adjacent the midfoot portion of the footbed does not include any discrete raised areas.

* * * * *